US007761300B2

(12) United States Patent
Klingler

(10) Patent No.: US 7,761,300 B2
(45) Date of Patent: Jul. 20, 2010

(54) PROGRAMMABLE VIRTUAL EXERCISE INSTRUCTOR FOR PROVIDING COMPUTERIZED SPOKEN GUIDANCE OF CUSTOMIZED EXERCISE ROUTINES TO EXERCISE USERS

(76) Inventor: Joseph William Klingler, P.O. Box 3520, Los Altos, CA (US) 94024

( * ) Notice: Subject to any disclaimer, the term of this patent is extended or adjusted under 35 U.S.C. 154(b) by 1016 days.

(21) Appl. No.: 11/452,671

(22) Filed: Jun. 14, 2006

(65) Prior Publication Data

US 2007/0293370 A1 Dec. 20, 2007

(51) Int. Cl.
*G10L 13/00* (2006.01)

(52) U.S. Cl. ..... 704/260; 704/258; 482/9

(58) Field of Classification Search ..... 704/258, 704/260; 482/9
See application file for complete search history.

(56) References Cited

U.S. PATENT DOCUMENTS

| | | | | |
|---|---|---|---|---|
| 4,420,813 | A * | 12/1983 | Inoue et al. | 704/270 |
| 5,592,583 | A * | 1/1997 | Sakurai | 704/200 |
| 5,931,763 | A | 8/1999 | Alessandri | |
| 6,027,428 | A * | 2/2000 | Thomas et al. | 482/4 |
| 6,193,631 | B1 | 2/2001 | Hickman | |
| 6,456,973 | B1 * | 9/2002 | Fado et al. | 704/260 |
| 6,626,800 | B1 | 9/2003 | Casler | |
| 6,645,124 | B1 | 11/2003 | Clem | |
| 6,672,991 | B2 | 1/2004 | O'Malley | |
| 6,716,139 | B1 | 4/2004 | Hosseinzadeh-Dolkhani et al. | |
| 6,997,852 | B2 | 2/2006 | Watterson et al. | |
| 2002/0055419 | A1 | 5/2002 | Hinnebusch | |
| 2002/0058239 | A1 * | 5/2002 | Wang | 434/263 |
| 2002/0169635 | A1 * | 11/2002 | Shillingburg | 705/2 |
| 2005/0172975 | A1 * | 8/2005 | Downs | 128/898 |
| 2005/0202934 | A1 | 9/2005 | Olrik et al. | |
| 2005/0209050 | A1 * | 9/2005 | Bartels | 482/8 |
| 2006/0035774 | A1 | 2/2006 | Marks | |
| 2007/0094029 | A1 * | 4/2007 | Saito et al. | 704/260 |

* cited by examiner

*Primary Examiner*—Daniel D Abebe
(74) *Attorney, Agent, or Firm*—Brooks Kushman P.C.

(57) ABSTRACT

A programmable virtual exercise instructor processes a word processing document having text chunks corresponding to instructions of actions of an activity in order to communicate the instructions to a person performing the activity. The activity may be an exercise routine with the actions being exercises. The text chunks include words indicative of timing information associated with the text chunks. The exercise instructor converts the text chunks to speech and extracts the timing information from the text chunks. The exercise instructor audibly speaks each text chunk one at a time at a rate consistent with the timing information associated with the text chunk such that the instructions of the activity actions are audibly spoken to the person to thereby direct the person through the activity. The exercise instructor may visually display the text chunks such that the instructions of the activity actions are visually displayed to the person as well.

20 Claims, 5 Drawing Sheets

PROGRAMMABLE VIRTUAL EXERCISE INSTRUCTOR FOR PROVIDING COMPUTERIZED SPOKEN GUIDANCE OF CUSTOMIZED EXERCISE ROUTINES TO EXERCISE USERS

BACKGROUND OF THE INVENTION

1. Field of the Invention

The present invention relates to communicating exercise routines to exercise users.

2. Background Art

People perform a variety of exercise routines such as yoga, stretching, weightlifting, Pilates, Tai Chi, aerobics, etc. An exercise routine includes a sequence of exercises which are associated with some sort of duration such as a period of time in which a person is to perform an exercise, a number of breaths the person is to breathe while performing an exercise, a set of repetitions of an exercise the person is to perform, etc.

As an example, a yoga exercise routine includes a sequence of yogic exercises (i.e., asanas) such as a pigeon pose asana and a cobra pose asana. The asanas are associated with time periods in which the person is to hold the body positions. For example, the person is to hold the pigeon pose for twenty seconds and then hold the cobra pose for thirty seconds. Alternatively, the asanas are associated with a number of breaths that the person is to breathe while performing the asanas. In this case, the number of breaths define the time period in which the person is to hold the body pose. For example, the pigeon pose asana is associated with five breaths instead of being associated with a twenty second time period. As such, the person holds the pigeon pose until the person has taken five breaths. The asanas may be separated by a rest period such as one minute to allow the person to rest between asanas. Thus, the person rests for one minute after holding the pigeon pose before assuming the cobra pose.

As another example, a weightlifting exercise routine includes a sequence of weightlifting exercises such as a bench press exercise of ten bench press repetitions at 150 lbs. and an arm curl exercise of eight arm curl repetitions at 40 lbs. Thus, a person bench presses 150 lbs. ten times and then arm curls 40 lbs. eight times. The exercises may be associated with a time period in which the repetitions are to be performed. For example, each repetition of an exercise is allocated a certain time period (such as 5 seconds) in which the repetition is to be performed. Again, the exercises may be separated by a rest period such as two minutes to allow the person to rest between exercises. Thus, the person rests for two minutes after bench pressing before arm curling.

In a like manner, other types of exercise routines include a sequence of exercises. As described above, exercise routines share a common trait in that they include a sequence or series of exercises that are to be done a certain number of times and/or during a certain duration. In its basic form, an exercise routine includes a sequentially arranged series of exercise instructions or commands such as "Do 'A' for 1 minute", "Do ten repetitions of 'B'", "Do 'C' while taking five breaths", "Do 'D' for 2 minutes" etc., where 'A', 'B', and 'C' represent respective exercises and "D" represents a resting event. Accordingly, an exercise routine may be changed by modifying or deleting its instructions, by changing the sequential order of its instructions, by adding additional instructions, etc. Similarly, an exercise routine is created by arranging a sequence of exercise instructions.

The exercises included in an exercise routine for a person may be based on input from the person, exercise peers, fitness instructors, fitness literature, video and audio fitness programming, physicians and physical therapists, and the like. As such, persons may have their own customized exercise routines.

A person performing a customized exercise routine generally has an idea of which exercises to perform and in what order to perform the exercises. The person may refer to a paper having the instructions (for example, "Do 'A'", "Rest for a minute", "Do 'B'", etc.) written down. The person may refer to examples illustrating proper performance of the exercises. The person may look at a watch or clock while exercising to ensure that the exercises are performed in allotted durations. A problem with this approach is that the person effectively has two roles: an exerciser and an exercise instructor. That is, while performing the exercises (i.e., acting in the role of an exerciser), the person keeps track of which exercises have been performed and which are to be performed, monitors the exercise durations, memorizes or knows the order of the exercises, accesses literature illustrating proper performance of the exercises, and the like (i.e., acting in the role of an exercise instructor).

An entity that handles the role of an exercise instructor is a human fitness instructor. A person is able to focus on the role of an exerciser while performing an exercise routine with a human fitness instructor directing or guiding the person through the exercise routine. However, problems with this approach are that fitness instructors are relatively costly to many exercisers and may not be available at times desired by exercisers, many exercisers prefer to exercise in relative solitude without any perceived or actual intrusions by other people, many exercisers prefer to exercise in their own homes as opposed to fitness clubs having fitness instructors, many exercisers do not have time to meet with fitness instructors, etc.

It would be desirable for an entity other than a human fitness instructor and other than a person performing a customized exercise routine to handle the role of an exercise instructor while the person performs the exercise routine such that the person focuses on the role of an exerciser without handling exercise instructor responsibilities. It would be further desirable if the person or another entity such as a human fitness instructor creates the customized exercise routine by providing text indicative of exercise instructions to the exercise instructor entity such that the exercise instructor entity handles the exercise instructor responsibilities for any customized exercise routine created from text.

SUMMARY OF THE INVENTION

Accordingly, it is an object of the present invention to provide a programmable virtual exercise instructor which provides computerized spoken guidance of an exercise routine to an exercise user.

It is another object of the present invention to provide a programmable virtual exercise instructor which provides computerized spoken and visual guidance of an exercise routine to an exercise user.

It is another object of the present invention to provide a programmable virtual exercise instructor which converts text indicative of exercise instructions comprising an exercise routine into computerized spoken guidance for an exercise user.

It is another object of the present invention to provide a programmable virtual exercise instructor which converts text and visual information indicative of exercise instructions comprising an exercise routine into computerized spoken and visual guidance for an exercise user.

It is another object of the present invention to provide a programmable virtual exercise instructor which handles the role of an exercise instructor for a person performing an exercise routine such that the person can focus on the role of an exerciser without handling exercise instructor responsibilities.

It is another object of the present invention to provide a programmable virtual exercise instructor operable to receive a storage media having text indicative of exercise instructions of an exercise routine and operable to convert the text into computerized spoken guidance for an exercise user.

It is another object of the present invention to provide a programmable virtual exercise instructor method and system which extract timing or delay information in text indicative of exercise instructions of an exercise routine and then audibly plays the exercise instructions using the timing or delay information.

It is another object of the present invention to provide a programmable virtual exercise instructor method and system which use a text-to-speech synthesizer and a programmable timer to convert text indicative of timed exercise instructions of an exercise routine into speech and to audibly play the text at a rate consistent with the timing associated with the exercise instructions in order to provide computerized spoken guidance of the exercise routine to an exercise user.

In general, the present invention provides a programmable virtual exercise instructor which employs computer software technology. The exercise instructor is implemented on a computer system such as an Apple Macintosh computer running the OS X operating system.

The exercise instructor uses speech synthesis to convert text of a word processing document created by a user such as a person, a human fitness instructor into speech, a physician or physical therapist, a coach, etc. The exercise instructor speaks the text for a person to hear and takes into account timing information contained in the text while speaking the text. The text represents the written version of instructions of a sequentially arranged series of operations of an activity that would normally be led by a person such as a human fitness instructor for another person such as an exercise user performing the activity. The text includes (either explicitly or implicitly) timing information associated with at least some of the activity operations. Thus, the activity is a time-based activity such as an exercise routine or a physical therapy routine that is normally led by a human fitness instructor for an exercise user.

The exercise instructor extracts the timing information from the text when converting the text into speech. The exercise instructor then speaks the text using the timing information for a person to hear. For instance, if the text includes the instructions "do 'X' for 1 minute" and "do 'Y'", then the exercise instructor speaks the instruction "do "X' for 1 minute" and waits one minute before proceeding to speak the instruction "do 'Y'". As such, the exercise instructor allows a person to create a word processing document that is then spoken back to the person using speech synthesis, with timing interpreted directly from the document, so that the person can use a computer system to guide an activity that would normally be led by another person. As described, the exercise instructor is a computer based personal trainer, programmable with natural language such as English, French, Spanish, etc., for spoken guidance of time-based human activities such as exercise or physical therapy.

To allow a person to provide text indicative of instructions of a time-based activity to the exercise instructor in order to program the exercise instructor for paced audible playback of the instructions, the exercise instructor uniquely combines: word processing (for entry of the text instructions to be spoken back to the person), speech synthesis (for audibly playing the text instructions for the person to hear), natural language processing (for extraction of timing information from the text instructions), and time management (for taking account of the timing information to pace the audible playback of the instructions). Accordingly, the exercise instructor eliminates the need for a live teacher (e.g., a human fitness instructor, etc.) to lead a time-based activity (e.g., an exercise routine) for a person (e.g., an exercise user) and extends beyond the capabilities of fixed media (e.g., CD, DVD, etc.) for self-guided practice by the person of the activity.

A person may use the exercise instructor for home yoga practice with the exercise instructor filling the role of a human yoga instructor. Yoga provides a good example of the advantages associated with the exercise instructor in that yoga is popular and becoming more popular and a wide variety of yoga literature and other yoga reference materials exist. However, literature such as books are difficult for a person to use while practicing yogic poses and other materials such as CD's and DVD's are repetitive and generic. Further, the general goal of a yogi is to have a personal daily home practice. By creating textual documents indicative of yoga exercise routines using the exercise instructor, users are able to make their own yoga classes customized to the needs of their bodies using whatever materials they wish such as books, magazine articles, yoga instructor comments, CD's, DVD's, their own intuition, etc.

Users can use the exercise instructor for other activities that share the same basic structure as yoga—a sequence of actions, each performed for a predetermined amount of time. Other activities include activities that are closely related to yoga such as Pilates, Tai Chi, and various aerobic styled classes. Another activity is weightlifting in which the exercise instructor audibly instructs a weightlifter the weights to use for exercises, the names of the exercises to perform, and the order in which to perform the exercises and times the sets and breaks between the exercises to provide a repeatable weightlifting workout without the use of a human trainer. Another activity, which is similar to weightlifting, is physical therapy. If a person has the necessary equipment at home, the person can perform physical therapy exercises at home with the exercise instructor providing pacing and structure to the workout so that the person can repeat precisely what was prescribed by a physician or therapist.

In carrying out the above objects and other objects, the present invention provides a system and an associated method for communicating instructions of an activity to a person. The system includes a speaker and a processor. The processor is operative to receive a text stream corresponding to an activity having actions to be performed by a person performing the activity. The text stream includes text chunks respectively corresponding to instructions of the actions of the activity. The text chunks include words indicative of timing information associated with the text chunks. The processor converts the text chunks to speech and extracts the timing information from the text chunks. The processor audibly speaks via the speaker the text chunks one at a time at a rate consistent with the timing information such that the instructions of the activity actions are audibly spoken via the speaker to the person to thereby direct the person through the activity.

The activity may be an exercise routine and, in this case, the activity actions are exercises of the exercise routine.

The system may further include a display. In this case, the processor visually outputs via the display the text chunks for the person to see. The processor may highlight on the display each text chunk as the text chunk is being audibly spoken.

In an embodiment, words indicative of timing information associated with the text chunks include explicit timing words representative of units of time for the instructions corresponding to the text chunks such as "minutes" and "seconds". In an embodiment, words indicative of timing information associated with the text chunks include implicit timing words representative of time durations for the instructions corresponding to the text chunks such as "breaths", "repetitions", "times", and "repps". The processor assigns a unit of time to each of the implicit timing words. The units of time assigned to the implicit timing words are configurable by an operator of the processor.

In an embodiment, each text chunk includes a text chunk termination character which designates the end of the text chunk such that the processor distinguishes the text chunks from one another when converting the text chunks into speech.

The text chunks are preferably arranged in the text stream in a sequential order. The processor audibly speaks via the speaker the text chunks in the sequential order such that the instructions of the activity actions are audibly spoken in the sequential order.

A text chunk may include a word indicative of a command to keep the text chunk silent when the processor audibly speaks via the speaker the text chunks. In this case, the processor audibly speaks via the speaker the text chunks one at a time at a rate consistent with the timing information with the exception of speaking the text chunks having the silent command.

The processor may audibly output via the speaker a bell or chime sound to notify the person that the instruction corresponding to a text chunk has expired and that the next instruction will be audibly played.

The above objects, other objects, and advantages of the present invention are readily apparent from the following detailed descriptions thereof when taken in connection with the accompanying drawings.

DETAILED DESCRIPTION OF THE PREFERRED EMBODIMENT(S)

Figure 1:
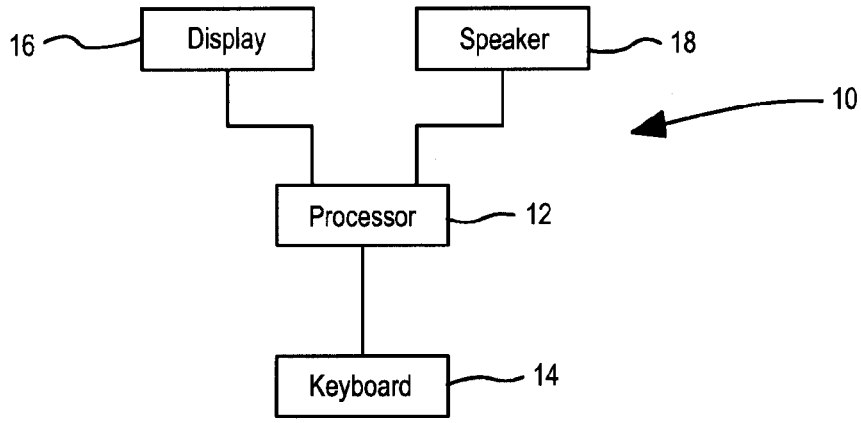
FIG. 1 illustrates a block diagram illustrating the basic elements of a programmable virtual exercise instructor in accordance with an embodiment of the present invention.

Referring now to FIG. 1, a block diagram illustrating basic elements of a programmable virtual exercise instructor 10 in accordance with an embodiment of the present invention is shown. Exercise instructor 10 is generally embodied as a computer system having a processor 12, a display 16, and a speaker 18. Processor 12 is configured to receive a word processing document which may be inputted by a user via a keyboard 14, via a menu driven by a mouse, etc. Processor 12 is configured to receive the word processing document from other sources such as the Internet or an e-mail server, portable storage mediums, and the like. Processor 12 is configured to receive visual pictures which are to be associated with the word processing document. The visual pictures may be inputted by the user or obtained from a scanner or a third party via the Internet or an e-mail server, and the like.

The word processing document represents a written version of a time-based activity to be performed by a person. The activity includes a sequence of actions to be performed by the person in a sequential order with the actions having predetermined time amounts in which the actions are to be performed. As such, the document includes a stream of text chunks arranged in the sequential order with each text chunk being a written instruction of an action of the activity. Each text chunk includes (either explicitly or implicitly) timing information defining the amount of time in which the corresponding action is to be performed.

Exercise instructor 10 converts the written instructions (i.e., the text chunks) corresponding to the activity actions into speech using a text-to-speech synthesizer. Exercise instructor 10 filters the written instructions to extract the timing information associated with the activity actions. In turn, exercise instructor 10 audibly plays (i.e., speaks) the written instructions in the sequential order for the person to hear. Exercise instructor 10 times the audible playing of the written instructions using the timing information such that the instructions are audibly played at a rate consistent with the timing information. In effect, exercise instructor 10 audibly directs a person through activity actions of a time-based activity using a word processing document describing the activity.

An exercise routine such as weightlifting, yoga, etc. is a time-based activity. An exercise routine includes a sequence of activity actions (i.e., exercises) that a person is to sequentially perform in predetermined time durations. As such, exercise instructor 10 audibly directs a person through exercises making up an exercise routine in the sequential order using a word processing document which describes the exercise routine. In this case, the document represents a written version of the exercise routine. The document includes a stream of text chunks arranged in the sequential order with each text chunk being a written instruction of an exercise of the exercise routine. Each text chunk includes timing information defining the amount of time in which the corresponding exercise is to be performed.

The person performing the exercise routine or another person may create the word processing document. In turn, the document is provided to processor 12. Processor 12 converts the stream of text chunks in the document into speech and extracts the timing information from the text chunks. Processor 12 then audibly plays the text chunks through speaker 18 for the person to hear at a rate consistent with the timing information. Processor 12 may also visually display the text stream using display 16 for the person to see. In this case, processor 12 may visually highlight the text chunk currently being audibly played for the person to see as the person is hearing the text chunk. Similarly, processor 12 may visually highlight portions of the text stream which have already been audibly played such that the person can discern progress through the exercise routine.

Figure 2:
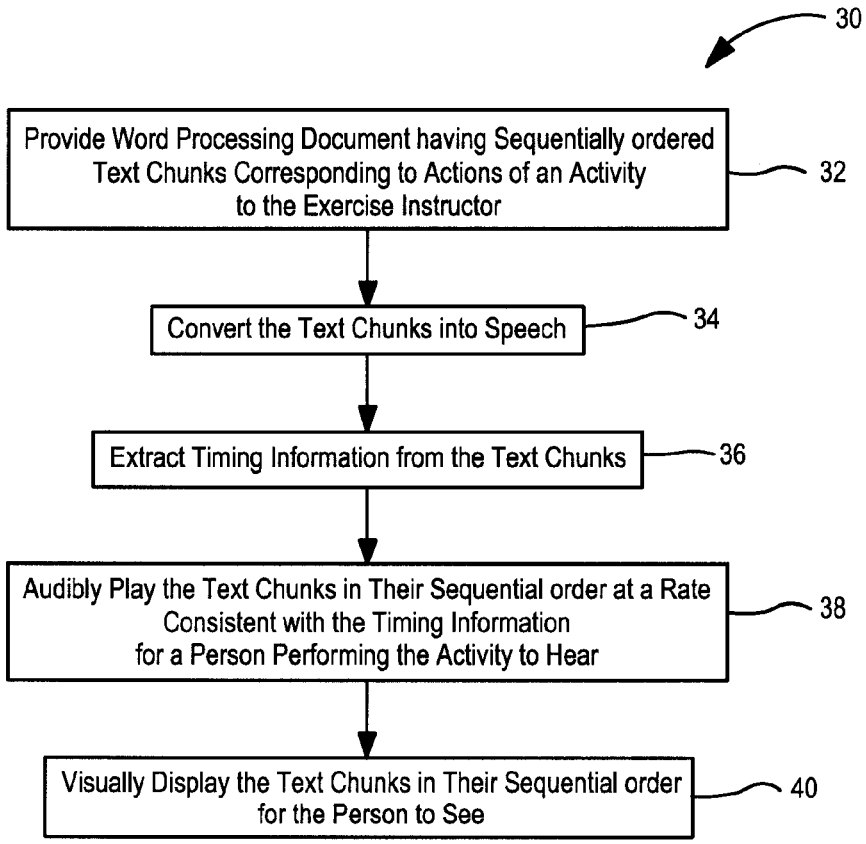
FIGS. 2 and 3 respectively illustrate basic and advanced flow charts describing operation of the programmable virtual exercise instructor receiving information indicative of an exercise routine and guiding an exercise user through the exercise routine in accordance with embodiments of the present invention.

Referring now to FIG. 2, a flow chart 30 describing basic operation of exercise instructor 10 is shown. The basic operation includes exercise instructor 10 receiving information indicative of a time-based activity such as an exercise routine and guiding a person such as an exercise user through the activity. Initially, a word processing document representing a written version of the activity is created by sequentially arranging a stream of text chunks with each text chunk being a written instruction of an action of the activity. Each text chunk includes timing information indicative of the amount of time in which the corresponding action is to be performed by the user. As such, the document represents a written version of a time-based activity having a sequence of actions to be performed by a person in a sequential order with the actions being associated with time periods in which the person is to perform the actions. The document is provided to exercise instructor 10 as shown in block 32.

Exercise instructor 10 converts the text chunks into speech as shown in block 34. Exercise instructor 10 filters the text chunks to extract the timing information associated with the corresponding activity actions as shown in block 36. Exercise instructor 10 audibly plays the text chunks in the sequential order at a rate consistent with the timing information for the person to hear as shown in block 38. Exercise instructor 10 may also visually display the text chunks being audibly played for the person to see as shown in block 40. Exercise instructor 10 may highlight the visual display of the text chunk as the text chunk is being audibly played for the person to see as the person is hearing the text chunk. As such, exercise instructor 10 audibly and visually directs a person through activity actions making up a time-based activity using a word processing document describing the activity.

With reference to FIG. 2, it is noted that the text chunks may or may not be converted to speech before the timing information is extracted from the text chunks. For example, in one embodiment, the timing information is extracted from all of the text chunks before the text chunks are converted into speech. Further, the text chunks may or may not be stored after being converted into speech. For example, in one embodiment, when it comes time to audibly play a text chunk as shown in block 38, the text chunk is converted into speech and then audibly played on the fly. In this case, the text-to-speech conversion is not stored. As such, flow chart 30 of FIG. 2 represents an example of the operation steps of exercise instructor 10 and such operation steps may not be temporally arranged in an order corresponding to the block order shown in FIG. 2 (for example, block 36 may precede in time block 34).

Exercise instructor 10 may audibly play the text chunks using different computer voices. Such computer voices include military instructor voices, coaching voices, man voices, woman voices, etc. As such, exercise instructor 10 may be configured by the person performing a time-based activity, by the creator of the document representing the activity, etc., to use different computer voices while audibly playing back certain ones of the text chunks.

With reference to FIG. 2, an example of a time-based activity which exercise instructor 10 directs a person through using a document describing the activity is a weightlifting exercise routine. In this example, the document represents a written version of an exercise routine which includes a series of weightlifting exercises to be performed by the person. Thus, the document includes a stream of text chunks arranged in a sequential order with each text chunk being a written instruction corresponding to a weightlifting exercise and/or a resting period. For example, a first text chunk is "Bench press sixty kilograms 10 times and then rest for 2 minutes", a second text chunk is "Do 8 repetitions of the military press using forty kilograms", a third text chunk is "Take 5 breaths", a fourth text chunk is "Do 3 repetitions of the military press using forty kilograms and then rest for 30 seconds", etc. As such, the text stream represents written instructions of a weightlifting exercise routine to be performed by the person. Some of the text chunks (e.g., "Do 3 repetitions of the military press using forty kilograms") are written instructions of specific exercises, some of the text chunks (e.g., "Rest for 20 seconds") are written instructions of resting periods between exercises, and some of the text chunks (e.g., "Bench press sixty kilograms 10 times and then rest for 2 minutes") are written instructions of specific exercises and resting periods.

As described, the text chunks contain keywords such as "times", "minute", "repetitions", "seconds", and "breaths" which are understood to exercise instructor 10 as being timing information contained in the text chunks. The timing information is associated with the exercises and is a part of the exercise routine. Exercise instructor 10 extracts the keywords along with their associated numeric values (e.g., "10" times, "5" breaths, "2" minutes, etc.) from the text chunks. In one embodiment, the numeric values associated with the keywords are created in the word processing document using their numeric representation such as "1" instead of their language equivalent such as "one". Further, in one embodiment, the numeric values are placed in the document adjacent to their associated keywords such as "1 minute". Likewise, in one embodiment, the written instructions for weights to be used are created in the document using their language equivalent such as "forty kilograms" instead of "40 kilograms". Alternatively, in one embodiment, the written instructions for weights to be used are created using their numeric representation such as "40 kilograms". As the numeral "40" is not adjacent to a keyword indicative of timing information, exercise instructor 10 understands that the numeral "40" does not represent a quantity of time. In this instance, exercise instructor 10 converts the numeral "40" to the spoken word "forty" when audibly playing the text chunk "40 kilograms". In these ways, exercise instructor 10 may discern the timing information from the text chunks.

Keywords such as "minutes" and "seconds" are explicit timing information contained in the text chunks in the sense that these words represent commonly understood and defined units of time. Thus, exercise instructor 10 counts a one minute period of time using a clock when audibly playing, for example, the instruction "Rest for 1 minute".

Keywords such as "breaths", "repetitions", and "times" are implicit timing information contained in the text chunks in the sense that exercise instructor 10 assigns configurable timing intervals to each of these words. For instance, exercise instructor 10 assigns a four second interval to the keyword "breath". As such, exercise instructor 10 counts twenty seconds using the clock for the instruction "5 breaths". A person may program exercise instructor 10 to assign different timing intervals to the keywords. For example, the person may program exercise instructor 10 such that each "breath" is allocated five seconds, each "repetition" is allocated six seconds, and each "time" is allocated seven seconds, etc.

In one embodiment, in order to enable exercise instructor 10 to distinguish one text chunk from another text chunk (i.e., to distinguish one written instruction from another written instruction), each text chunk includes at its end a symbol such as ";" which designates the text chunk termination. For instance, the third text chunk of "Take 5 breaths" is inputted by the creator of the word processing document into the document as the text chunk "Take 5 breaths;". In this way, exercise instructor 10 discerns the written instructions (i.e., the text chunks) from one another and, consequently, discerns the exercises and the resting periods from one another such that the written instructions representative of the exercises and the rest periods are audibly played in their proper sequential order with their proper timings.

The use of a text chunk termination character such as ";" at the end of each text chunk corresponding to an activity instruction (such as an exercise instruction and/or a resting instruction) represents an example for enabling exercise instructor 10 to distinguish the activity instructions from one another. By distinguishing the activity instructions, exercise instructor 10 can ensure that there is some sort of delay after audibly playing an activity instruction before proceeding to audibly play the next activity instruction.

Instead of the use of text chunk termination characters, another example for enabling exercise instructor 10 to distinguish text chunks corresponding to exercise instructions from one another includes requiring that the name of the exercises be placed at the beginning of the text chunks. Exercise instructor 10 may then refer to an internal database of exercise names to identify the beginning of each exercise instruction (i.e., to identify the beginning of each text chunk). This example provides an implicit separation of the exercises without the need for the creator of the word processing document to input special text chunk termination characters.

Another example includes the use of a keyword(s) prefix to indicate the beginning of an exercise instruction. For instance, such keywords could be "Perform", "Practice", and/or "Do". Each exercise instruction would begin with one of these keywords as in "Perform 10 repetitions of biceps curl" or "Practice cobra pose for 15 seconds".

Alternatively, to enable exercise instructor 10 to distinguish the text chunks from one another, other language analysis techniques could be employed to use verb placement, specific action keywords, proximity of an exercise name to specific keywords, etc. Each of these examples would support a specific grammatical construction depending on chosen rules.

When the person is to perform the exercise routine described in the document, exercise instructor 10 converts the text chunks into speech and extracts the timing information from the text chunks. Exercise instructor 10 then audibly plays the text chunks in the sequential order at a rate consistent with the timing information for the person to hear. For instance, in this example, exercise instructor 10 audibly plays the phrase "Bench press sixty kilograms ten times and then rest for two minutes". Exercise instructor 10 waits a period of time for the person to do the bench press ten times (for example, thirty seconds such that the person has three seconds per bench press repetition) and then counts down the two minutes before proceeding to audibly play the next text chunk. Subsequently, exercise instructor 10 audibly plays the phrase "Do eight repetitions of the military press using forty kilograms" and then waits another period of time for the person to do the military press eight times (for example, twenty four seconds). Subsequently, exercise instructor 10 audibly plays the next text chunk and this process is continued until all of the text chunks have been audibly played. In this manner, exercise instructor 10 directs the person through the exercises and rest periods making up the weightlifting exercise routine.

Figure 3:
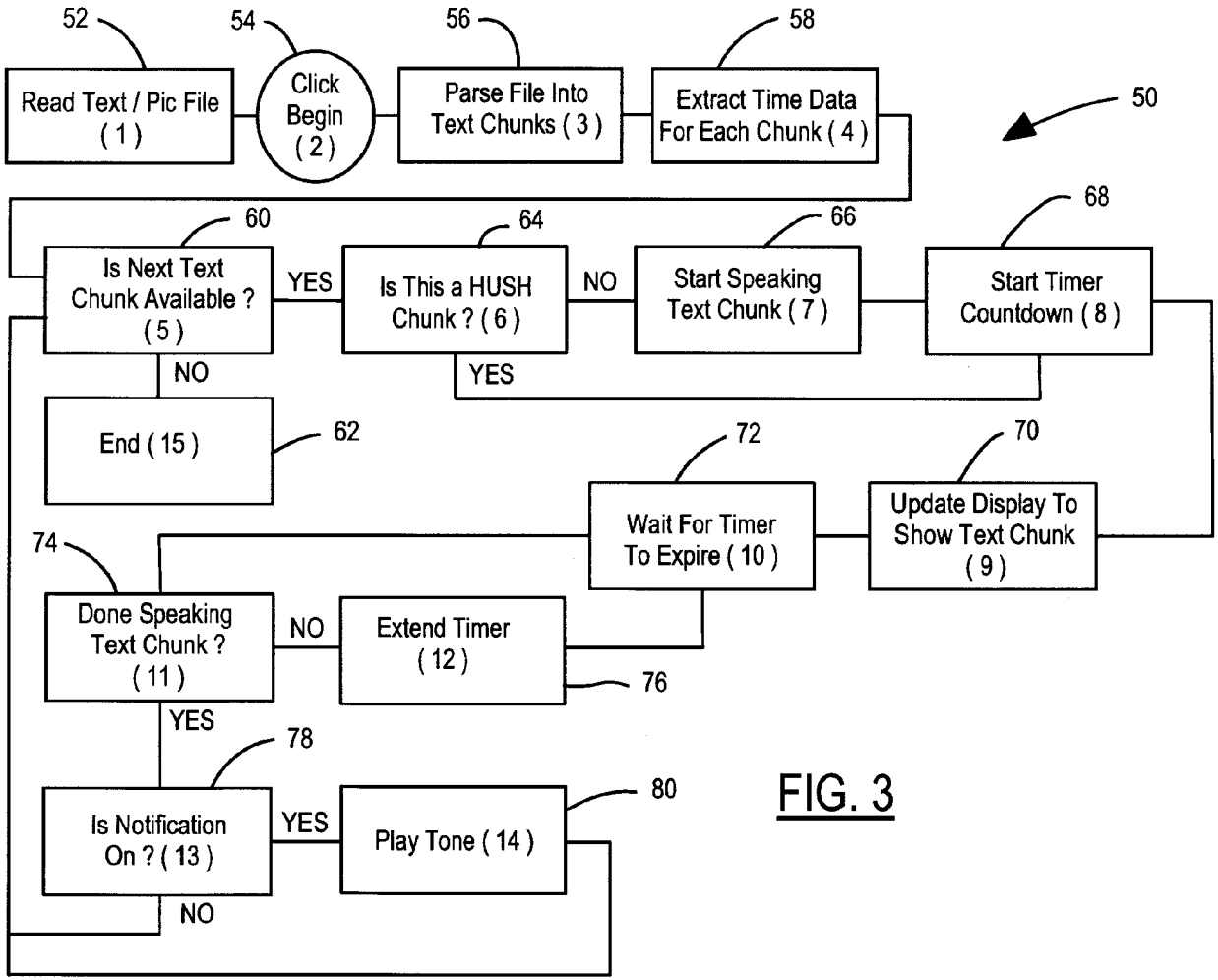

Referring now to FIG. 3, with continual reference to FIGS. 1 and 2, a flow chart 50 describing advanced operation of exercise instructor 10 is shown. Flow chart 50 illustrates a top level process used by exercise instructor 10. Again, the advanced operation includes exercise instructor 10 receiving information indicative of an exercise routine (i.e., a time-based activity) and guiding a person such as an exercise user through the exercise routine.

Initially, a user uses a standard word processor which may be provided by processor 12 of exercise instructor 10 to create text files having optional pictures. The natural language such as English entered into these text files forms the data set that processor 12 operates on to create the virtual instructor experience. A technical implementation is the standardized Rich Text Format with Graphics, an RTFD file package, on an Apple Macintosh OS X. While text may be entered into processor 12 and processed without saving to a file, creating documents and saving them to files represents a standard mode of operation. Processor 12 receives a word processing document having text chunks with optional pictures and then reads the document and the optional picture files as shown in block 52. The document represents a written version of a time-based activity such as an exercise routine.

Exercise instructor 10 has two modes of operation: edit mode and virtual instructor mode. While in the edit mode, exercise instructor 10 operates as a word processor as described above with respect to block 52. Upon the person clicking a begin button associated with exercise instructor 10 as shown in block 54, the exercise instructor switches into the virtual instructor mode during which it runs the text processing loop illustrated in FIG. 3 until either no more text is to be processed or until the person manually returns the exercise instructor back to the edit mode.

The processing loop of the virtual instructor mode initially includes processor 12 parsing the inputted text stream of the document into text chunks as shown in block 56. Processor 12 separates the text chunks of the text stream based on the locations of a 'chunk separator' character (which is, as an example, the character ";"). (Again, as noted above, other techniques which do not use 'chunk separator' symbols such as ";" may be used to enable processor 12 to separate and distinguish the text chunks from one another.) In this way, processor 12 can sequentially arrange the text chunks in a sequential order. Preferably, the sequential order of the text chunks is a top-to-bottom order in which the text chunks are arranged in the text stream.

Processor 12 then extracts the timing information associated with each text chunk as shown in block 58. Processor 12 scans each text chunk for specific keywords to classify the text chunk. Certain keywords such as "breaths", "minutes", "seconds", "repetitions" or "repps", "times", etc., specify the length of time for which to hold the text chunk (i.e., specify the timing information associated with the instruction corresponding to the text chunk). Other keywords such as "hush" and "chime" respectively define if a text chunk is to be audibly spoken and if a chime is to be sounded for a text chunk. Processor 12 tags each text chunk according to the results of the keyword text scan.

Exercise instructor 10 then begins the process of audibly playing the text chunks for a person to hear. Exercise instructor 10 determines whether a current text chunk of the text stream has not yet been audibly played as shown in block 60. A current text chunk is the next text chunk in the sequential order of the text stream created at block 56 after the previous text chunks which have already been audibly played. If a current text chunk is available, then processor 12 continues with the text chunk processing loop. If a current text chunk is not available, then the entire text stream has been already processed and audibly played so the text chunk processing loop ends as shown in block 62 and exercise instructor 10 returns to the edit mode.

Exercise instructor 10 continues with the text chunk processing loop by starting the process of audibly playing the current text chunk. Processor 12 starts this process by determining if the current text chunk is a "hush" chunk as shown in block 64. As described above, processor 12 tagged each text chunk with a type in block 58. If the keyword "hush" was found in the scan of a text chunk, then the person who has written the text stream has requested that the text chunk be timed but not spoken. An example of such a text chunk is the text chunk "Hush for 1 minute". If the current text chunk is tagged as a "hush" text chunk, then block 66 is skipped and processing proceeds to block 68 such that exercise instructor 10 does not audibly speak this text chunk but does time the text chunk. For all other types of text chunks, processor 12 proceeds to block 66.

In block 66, exercise instructor 10 starts audibly speaking the current text chunk. In this step, processor 12 feeds the contents of the current text chunk into a text-to-speech synthesizer. The synthesizer then speaks the text chunk which is outputted through speaker 18 for the person to hear. The synthesizer speaks the current text chunk in parallel with processor 12 proceeding to block 68.

In block 68, exercise instructor 10 starts the timer countdown for the current text chunk. Exercise instructor 10 times the delivery of the audible (i.e., verbal) output of the current text chunk to the person listening to the exercise routine. This is achieved by processor 12 using a countdown timer that is seeded in block 68 with the timing information extracted from the current text chunk in block 58. Thus, a written instruction such as "Perform 10 repps of Triceps Curl with fifteen pound dumbbells;" can be both spoken as an instruction by the speech synthesizer and also properly interpreted by processor 12 to create the correct timing delay in order to allow the exercise user sufficient time (e.g., 10*3 seconds=30 seconds) to perform the exercise before exercise instructor 10 proceeds to the next text chunk (i.e., the next written exercise instruction).

Exercise instructor 10 displays the text chunks of the text stream in a display for the person to see as the person is hearing the text chunks. To this end, exercise instructor 10 updates its display to visually show the current text chunk as shown in block 70. Exercise instructor 10 highlights the current text chunk in the display as the current text chunk is being audibly played to the person in order to provide the person a visual cue as to the current location in the text stream.

In block 72, exercise instructor 10 waits for the timer to expire. Because the current text chunk that was started to be audibly spoken by exercise instructor 10 in block 66 is speaking at a predetermined, configurable rate and the timer is counting down, there is no work to do until the timer expires so the text processing loop sits in a wait state. The text processing loop continues to block 74 after the countdown timer is finished counting the period of time associated with the current text chunk.

In block 74, exercise instructor 10 checks to see if the entire current text chunk has been audibly played. Because a text chunk may take longer to be spoken then the time period associated with the text chunk exercise instructor 10 checks to see if the speech synthesizer has completed speaking the current text chunk in block 74. If the current text chunk is still being spoken, then exercise instructor 10 extends the timer as shown in block 76. In block 76, exercise instructor 10 increments the timer value by a small amount (for instance, one second) and then the text processing loop returns to block 72 to wait for the timer to expire again. Otherwise, the text processing loop continues to block 78.

In block 78, exercise instructor 10 checks to see if a notification is on for the current text chunk. Exercise instructor 10 may play a tone at the end of any text chunk that is longer than, for example, fifteen seconds to notify the person that the activity associated with the current text chunk is to end and that the next text chunk corresponding to another activity will be audibly played shortly. The feature can be turned on and off in exercise instructor 10 so a check is made at block 78. If the feature is on, then the text processing loop proceeds to block 80. In block 80, exercise instructor 10 audibly plays audio for a user selected tone such as a bell chime, waits for the tone to finish playing, and then returns to block 60 where the text processing loop proceeds with the next text chunk in the text stream. Otherwise, the text processing loop directly returns to block 60.

Figure 4:
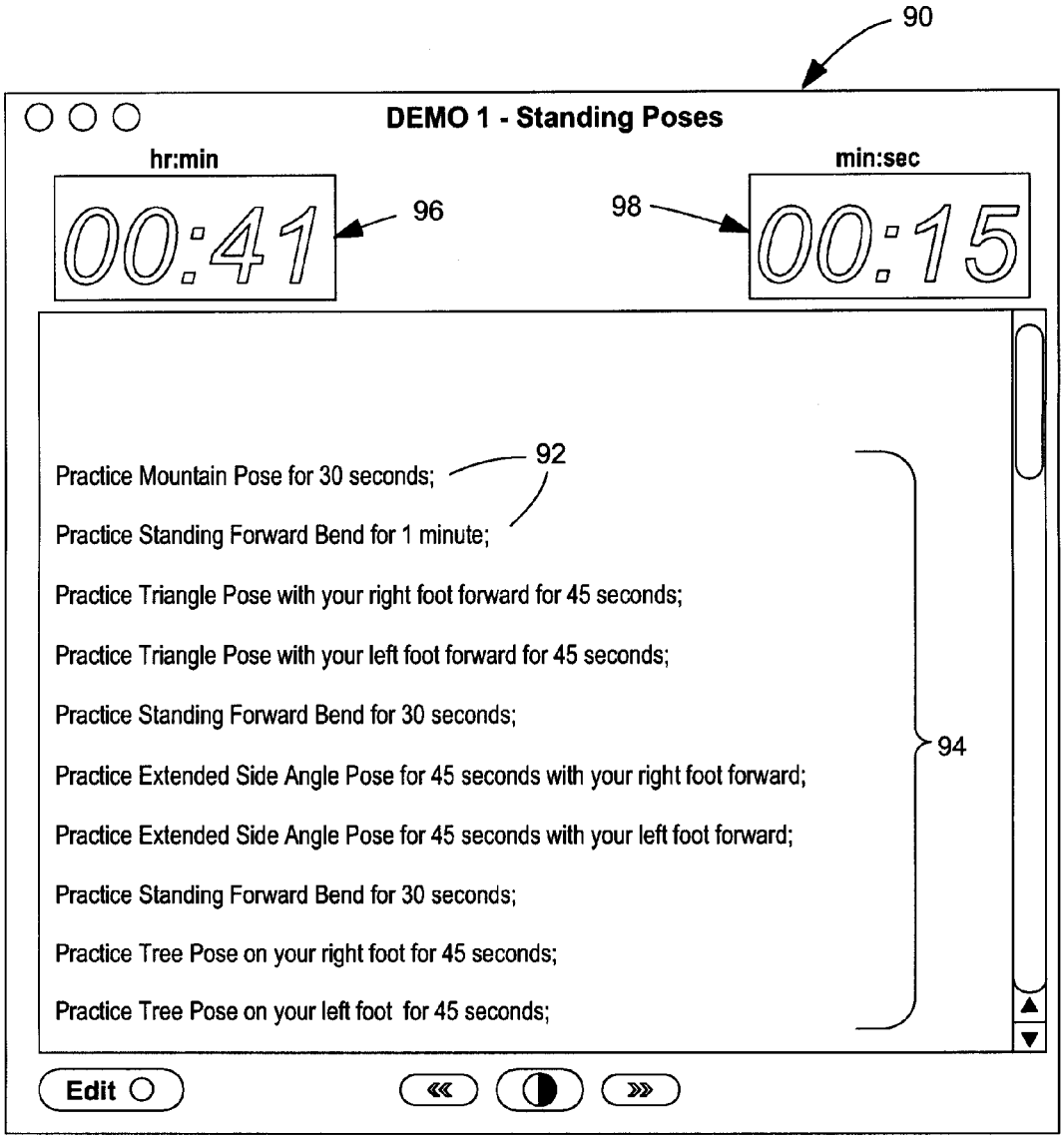
FIG. 4 illustrates an example of the programmable virtual exercise instructor visually displaying exercise instructions which the instructor audibly plays to an exercise user to guide the user through an exercise routine in accordance with an embodiment of the present invention.

Referring now to FIG. 4, an example of a visual output 90 displayed by exercise instructor 10 on display 16 is shown. Visual output 90 includes the text chunks of a text stream corresponding to an activity. In this case, the text chunks are exercise instructions 92 and the text stream corresponds to an exercise routine 94. In this case, exercise routine 94 is a yoga exercise routine and exercise instructions 92 are yoga exercise instructions. Visual display 90 includes a first clock 96 which represents the elapsed time of the exercise routine. Visual display 90 includes a second clock 98 which is indicative of the time left for the exercise instruction currently being audibly played. Exercise instructor 10 outputs visual display 90 in order to visually display the exercise instructions which the exercise instructor audibly plays to an exercise user to guide the user through the exercise routine in accordance with an embodiment of the present invention.

Figure 5:
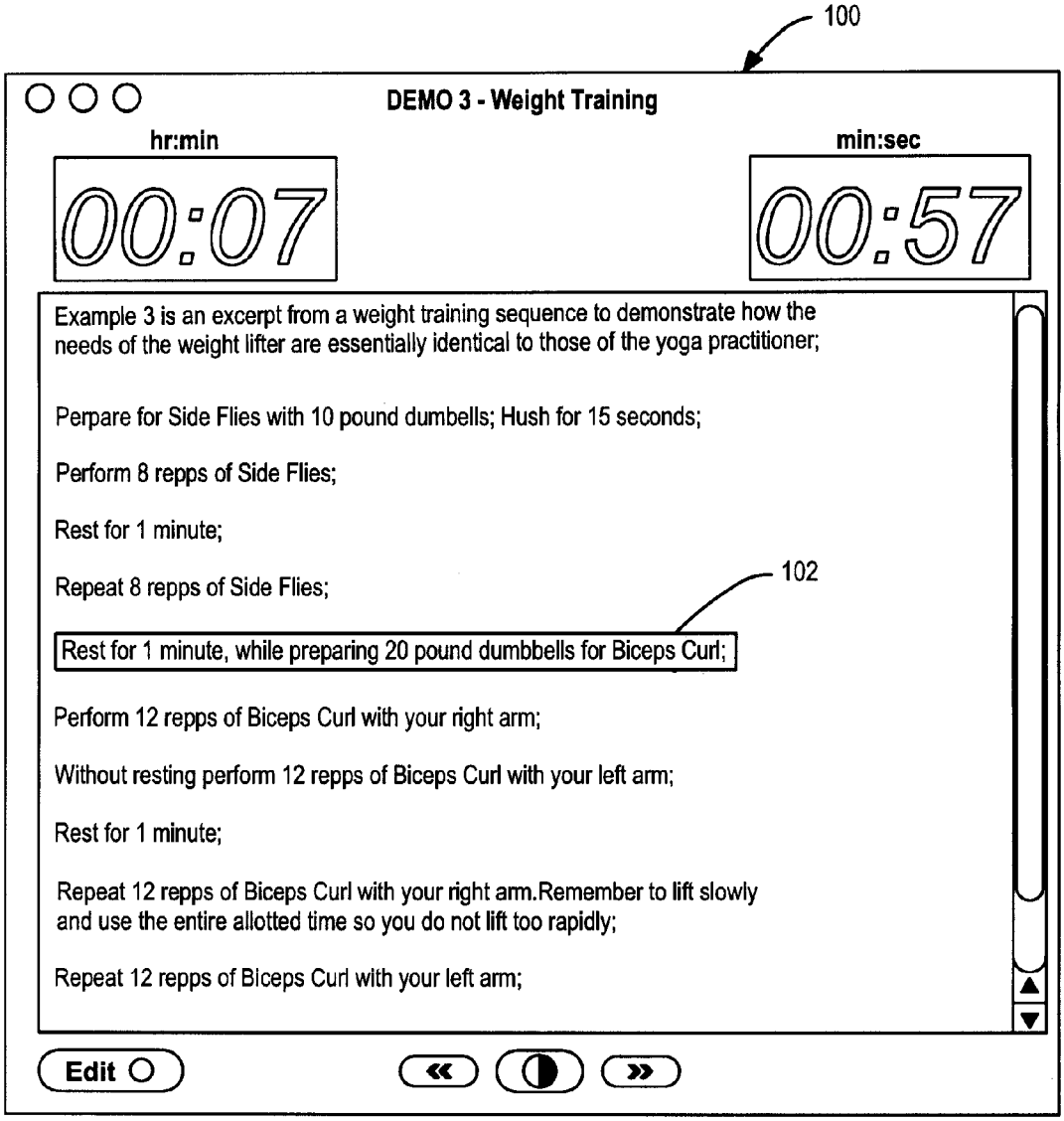
FIG. 5 illustrates an example of the programmable virtual exercise instructor visually displaying exercise instructions which the instructor highlights as the instructor audibly plays the instructions to an exercise user to guide the user through an exercise routine in accordance with an embodiment of the present invention.

Referring now to FIG. 5, another example of a visual output 100 displayed by exercise instructor 10 on display 16 is shown. Visual output 100 includes weightlifting exercise instructions of a weightlifting exercise routine. Visual output 100 highlights the current exercise instruction currently being audibly played to cue the exercise user to this exercise instruction.

Figure 6:
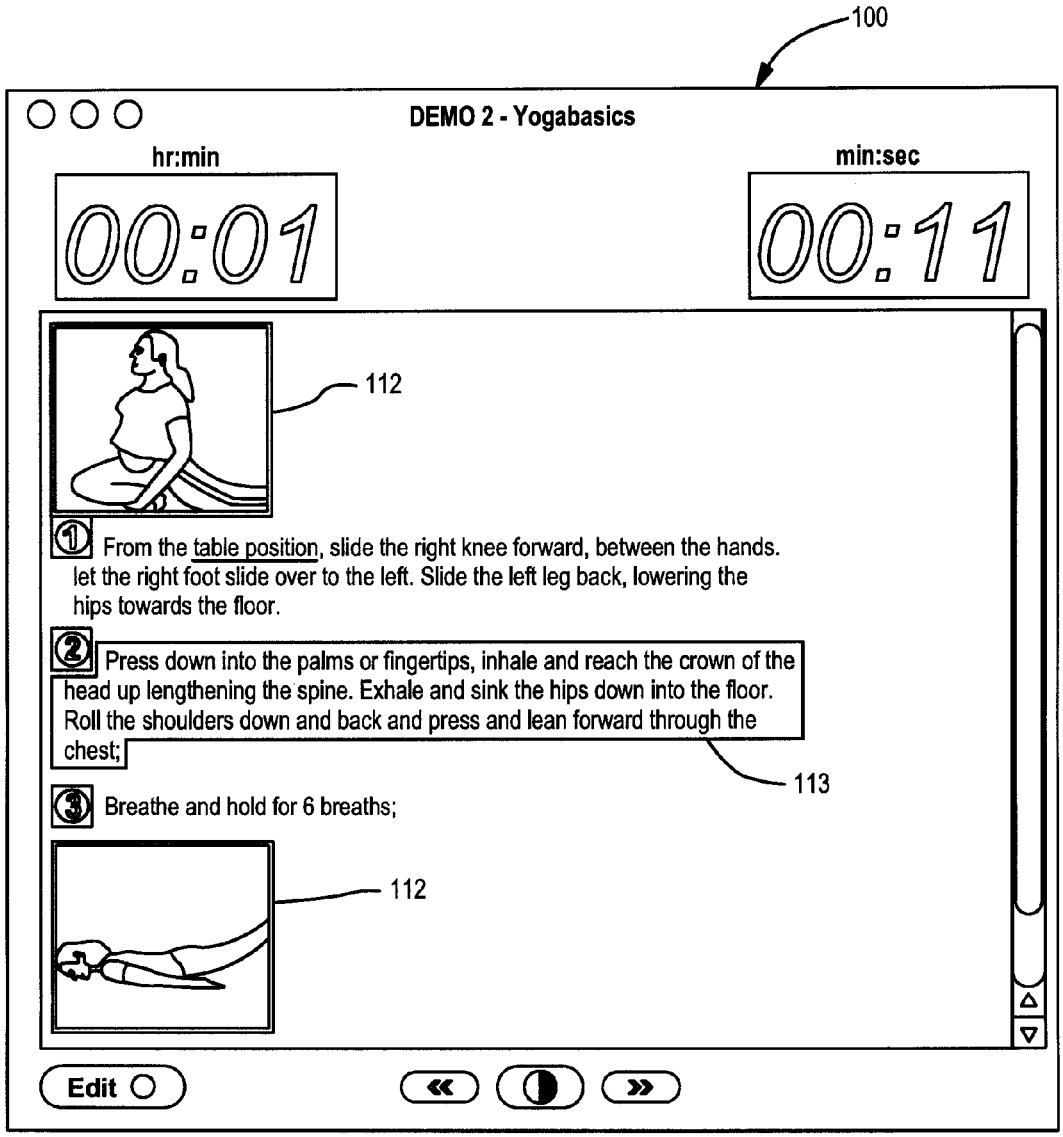
FIG. 6 illustrates an example of the programmable virtual exercise instructor visually displaying exercise instructions which the instructor highlights as the instructor audibly plays the instructions to an exercise user along with visually displaying pictures of the exercises to guide the user through an exercise routine in accordance with an embodiment of the present invention.

Referring now to FIG. 6, another example of a visual output 110 displayed by exercise instructor 10 on display 16 is shown. Visual output 110 includes yoga exercise instructions of a yoga exercise routine. Visual output 110 highlights the current yoga instruction 113 currently being audibly played to cue the exercise user to this yoga instruction. Visual output 110 further includes pictures 112 of other yoga users performing the yoga exercises corresponding to the yoga exercise instructions to illustrate to the exercise user how these exercises are done properly.

With reference to FIG. 6, it is noted that highlighted yoga instruction 113 represents an example of a text chunk that is void of (explicit or implicit) keywords indicative of timing information. In the event of converting such a text chunk to speech for audible playback of the text chunk, exercise instructor 10 determines the size of the text chunk (for example, based on the total amount of characters in the text chunk) to automatically generate a time duration to associate with the text chunk. Exercise instructor 10 may add the generated time durations of the text chunks void of timing information with the time durations of the text chunks having timing information to determine a total time duration of the entire activity. Exercise instructor 10 counts down this total time duration as the exercise instructor 10 guides a person through the activity by audibly playing the text chunks in their sequential order using their associated time durations. As such, there is no requirement that each text chunk have a keyword indicative of timing information.

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A system for communicating instructions of an activity to a person, the system comprising:

a speaker; and a processor operative to receive a text stream having text chunks, each text chunk being a written representation of an instruction of an action of an activity to be performed by a person and including a word with an associated numeric value which are indicative of timing information defining an amount of time in which the activity action corresponding to the text chunk is to be performed;

wherein the processor converts the text chunks to speech and extracts the timing information from the text chunks to determine for each text chunk the amount of time in which the activity action corresponding to the text chunk is to be performed;

wherein the processor audibly speaks via the speaker one of the text chunks such that the activity action instruction represented by the one of the text chunks is audibly spoken via the speaker to the person;

wherein upon the activity action instruction represented by the one of the text chunks being audibly spoken, the processor waits for the amount of time in which the activity action corresponding to the one of the text chunks is to be performed;

wherein upon the amount of time in which the activity action corresponding to the one of the text chunks is to be performed has expired, the processor audibly speaks via the speaker a next one of the text chunks such that the activity action instruction represented by the next one of the text chunks is audibly spoken via the speaker to the person.

2. The system of claim 1 wherein:

the activity is an exercise routine and the activity actions are exercises of the exercise routine.

3. The system of claim 1 further comprising:

a display;

wherein the processor visually outputs via the display the text chunks for the person to see.

4. The system of claim 3 wherein:

the processor highlights on the display each text chunk as the text chunk is being audibly spoken.

5. The system of claim 1 wherein:

words indicative of timing information associated with the text chunks include explicit timing words representative of units of time for the instructions corresponding to the text chunks such as "minutes" and "seconds".

6. The system of claim 1 wherein:

words indicative of timing information associated with the text chunks include implicit timing words representative of time durations for the instructions corresponding to the text chunks such as "breaths", "repetitions", "times", and "repps".

7. The system of claim 6 wherein:

the processor assigns a unit of time to each of the implicit timing words, wherein the units of time assigned to the implicit timing words are configurable by an operator of the processor.

8. The system of claim 1 wherein:

each text chunk includes a text chunk termination character which designates the end of the text chunk such that the processor distinguishes the text chunks from one another when converting the text chunks into speech.

9. The system of claim 1 wherein:

the text chunks are arranged in the text stream in a sequential order;

wherein the processor audibly speaks via the speaker the text chunks in the sequential order such that the instructions of the activity actions are audibly spoken in the sequential order.

10. A system for communicating instructions of an activity to a person, the system comprising:

a speaker; and a processor operative to receive a text stream having text chunks, each text chunk being a written representation of an instruction of an action of an activity to be performed by a person and including a word with an associated numeric value which are indicative of timing information defining an amount of time in which the activity action corresponding to the text chunk is to be performed;

wherein the processor converts the text chunks to speech and extracts the timing information from the text chunks to determine for each text chunk the amount of time in which the activity action corresponding to the text chunk is to be performed;

wherein the processor audibly speaks via the speaker one of the text chunks such that the activity action instruction represented by the one of the text chunks is audibly spoken via the speaker to the person;

wherein upon the activity action instruction represented by the one of the text chunks being audibly spoken, the processor waits for the amount of time in which the activity action corresponding to the one of the text chunks is to be performed;

wherein upon the amount of time in which the activity action corresponding to the one of the text chunks is to be performed has expired, the processor audibly speaks via the speaker a next one of the text chunks such that the activity action instruction represented by the next one of the text chunks is audibly spoken via the speaker to the person;

wherein the text stream further includes a hush type of text chunk, the hush type of text chunk includes a word and an associated numeric value which are indicative of timing information defining an amount of time which is to expire prior to a subsequent one of the text chunks being audibly spoken, wherein the processor waits for the amount of time associated with the hush type of text chunk to expire prior to audibly speaking via the speaker the subsequent one of the text chunks.

11. A method for communicating instructions of an activity to a person, the method comprising:

receiving a text stream having text chunks, each text chunk being a written representation of an instruction of an action of an activity to be performed by a person and including a word with an associated numeric value which are indicative of timing information defining an amount of time in which the activity action corresponding to the text chunk is to be performed;

converting the text chunks to speech;

extracting the timing information from the text chunks to determine for each text chunk the amount of time in which the activity action corresponding to the text chunk is to be performed;

audibly speaking one of the text chunks such that the activity action instruction represented by the one of the text chunks is audibly spoken to the person;

upon the activity action instruction represented by the one of the text chunks being audibly spoken, waiting for the amount of time in which the activity action corresponding to the one of the text chunks is to be performed; and upon the amount of time in which the activity action corresponding to the one of the text chunks is to be performed has expired, audibly speaking a next one of the text chunks such that the activity action instruction represented by the next one of the text chunks is audibly spoken to the person.

12. The method of claim 11 wherein:

the activity is an exercise routine and the activity actions are exercises of the exercise routine.

13. The method of claim 11 further comprising:

visually outputting the text chunks on a display for the person to see.

14. The method of claim 13 further comprising:

highlighting each text chunk on the display as the text chunk is being audibly spoken.

15. The method of claim 11 wherein:

words indicative of timing information associated with the text chunks include explicit timing words representative of units of time for the instructions corresponding to the text chunks such as "minutes" and "seconds".

16. The method of claim 11 wherein:

words indicative of timing information associated with the text chunks include implicit timing words representative of time durations for the instructions corresponding to the text chunks such as "breaths", "repetitions", "times", and "repps".

17. The method of claim 16 further comprising:

assigning a programmable unit of time to each of the implicit timing words.

18. The method of claim 11 wherein:

each text chunk includes a text chunk termination character which designates the end of the text chunk such that the processor distinguishes the text chunks from one another when converting the text chunks into speech.

19. The method of claim 11 wherein:

the text chunks are arranged in the text stream in a sequential order;

wherein audibly speaking each text chunk includes audibly speaking the text chunks in the sequential order such that the instructions of the activity actions are audibly spoken in the sequential order.

20. A method for communicating instructions of an activity to a person, the method comprising:

receiving a text stream having text chunks, each text chunk being a written representation of an instruction of an action of an activity to be performed by a person and including a word with an associated numeric value which are indicative of timing information defining an amount of time in which the activity action corresponding to the text chunk is to be performed;

converting the text chunks to speech;

extracting the timing information from the text chunks to determine for each text chunk the amount of time in which the activity action corresponding to the text chunk is to be performed;

audibly speaking one of the text chunks such that the activity action instruction represented by the one of the text chunks is audibly spoken to the person;

upon the activity action instruction represented by the one of the text chunks being audibly spoken, waiting for the amount of time in which the activity action corresponding to the one of the text chunks is to be performed; and upon the amount of time in which the activity action corresponding to the one of the text chunks is to be performed has expired, audibly speaking a next one of the text chunks such that the activity action instruction represented by the next one of the text chunks is audibly spoken to the person;

wherein the text stream further includes a hush type of text chunk, the hush type of text chunk includes a word and an associated numeric value which are indicative of timing information defining an amount of time which is to expire prior to a subsequent one of the text chunks being audibly spoken;

the method further comprising waiting for the amount of time associated with the hush type of text chunk to expire prior to audibly speaking the subsequent one of the text chunks.

* * * * *